United States Patent [19]

Masci

[11] Patent Number: 4,726,201

[45] Date of Patent: Feb. 23, 1988

[54] PROCEDURE FOR CUTTING, FOLDING AND SEWING SKINS OF FUR

[75] Inventor: Roberto Masci, Rome, Italy

[73] Assignee: Paola Fendi & S,lle S.a.S., Rome, Italy

[21] Appl. No.: 910,711

[22] Filed: Sep. 24, 1986

[30] Foreign Application Priority Data

May 27, 1986 [IT] Italy ..... 48066-A/86

[51] Int. Cl.[4] ..... C14B 1/00
[52] U.S. Cl. ..... 69/22
[58] Field of Search ..... 69/22

[56] References Cited

U.S. PATENT DOCUMENTS

| | | | |
|---|---|---|---|
| 931,235 | 8/1909 | Theuerkauf | 69/22 |
| 1,331,527 | 2/1920 | Rinfret | 69/22 X |
| 1,575,345 | 3/1926 | Kleinman | 69/22 X |
| 1,724,192 | 8/1929 | Greenberg et al. | 69/22 X |
| 2,161,830 | 6/1939 | Linet | 69/22 |
| 2,385,884 | 10/1945 | Schneider | 69/22 X |

*Primary Examiner*—Louis K. Rimrodt
*Attorney, Agent, or Firm*—Beveridge, DeGrandi & Weilacher

[57] ABSTRACT

A procedure for the cutting, folding and sewing of skins for use in the productin of fur garments is disclosed. In particular, the skins are cut, folded and sewn together to provide a particular transverse seam on the lower portion of one skin and the upper portion of another.

2 Claims, 6 Drawing Figures

PROCEDURE FOR CUTTING, FOLDING AND SEWING SKINS OF FUR

BACKGROUND OF THE INVENTION

The present invention relates to a procedure for cutting, folding and sewing skins for use in the manufacture of fur garments and to the product obtained using the inventive procedure. More particularly, the present invention relates to a procedure for cutting, folding and providing a transverse seam between the head part and the tail part of the skins for use in the manufacture of fur garments.

As is well known, fur coats have been precious garments, especially because of the skill of the workmanship required in the manufacturing operation, in addition to the type and the value of the skins used.

Fashion designers, stylists and manufacturers of fur garments have endeavored to lower the "status symbol" character as well as to reduce the level of skill in the craftsmanship required to produce such garments, and, rather, to emphasize the practical, simple and accessible features of such garments to a larger group of women in society.

It is seen that there is an ever increasing tendency to develop and to conduct further research in the field of materials and systems for tanning and dyeing skins, especially in the field of working techniques with the object of removing such techniques from the craftsman's realm in favor of processes which are more industrial in character.

As is well known, the process of producing a fashion collection starts with a creative idea and ends in the manufacture of garments to provide such fashion collection. The process comprises both steps of a creative nature and working steps of a technical nature.

After a model has been created, some tests are performed prior to the final manufacturing process.

Among such operations, the step of joining or sewing the skins together is of fundamental importance. The joining is performed both with longitudinal seams and, above all, with transverse seams whereby such joining step reliably provides the desired chromatic uniformity, fur coat length, and uniform density or thickness.

In the past, such reliability was attained at the expense of a remarkable waste of skins since such often did not perfectly satisfy the requirements demanded of them. In addition, reliability was strongly affected by the individual handicraft type stamp.

Accordingly, the need is evident for the introduction, into the technical steps of the production process, which steps are the basis of the creation of a collection of fur garments, of working procedures that one, free the product from any handicraft type stamp, that two, ensure good aesthetic qualities for the final product, and three, provide for greater exploitation of skins at the manufacturer's disposal.

More particularly, there is an evident need for a system for cutting, folding and sewing the skins transversely to ensure the required chromatic homogenity, as well as the required homogenity of the fur coat length, and density or thickness, and which system is advantageous from an economical viewpoint.

SUMMARY OF THE INVENTION

In order to achieve this objective, a procedure is disclosed according to the present invention for cutting, folding and sewing skins in the transverse direction.

According to this procedure the end portion of the tail part of one skin, that has been folded over on itself, is superimposed on the end portion of the head part of the next skin, whereby the first portion remains elevated with respect to the second one in the central part of the skin and covers a seam between the skins.

In the present disclosure, including the claims, the term "tail part" refers to the lower portion of a skin, whereas the term "head part" refers to the upper portion of a skin.

Accordingly, it is a specific object of the present invention to provide a procedure for cutting, folding and sewing skins. The procedure comprises the steps of cutting a lower end portion of a first skin between its longitudinal edges to have two oppositely inclining edges connected by a central horizontal edge; cutting an upper portion of a second skin to provide, from one of its longitudinal edges to the other longitudinal edge, a first inclined edge, a first provided longitudinal edge parallel to and extending forwardly of the longitudinal edges, a second inclined edge, a horizontal edge, a third inclined edge, a second provided longitudinal edge parallel to the first provided longitudinal edge and the longitudinal edges of the skin and a fourth inclined edge. The first and second provided longitudinal edges, the second and third inclined edges and the horizontal edge define tip portions. The inclined edges of the second skin complement the inclined edges of the first skin. The horizontal edge extending between the second and third inclined edges of the second skin has the same length as the horizontal central edge of the first skin. The upper portion of the second skin is further cut to provide inclined cut lines beginning at the intersections of the horizontal edge with the second and third inclined edges. Then, the central horizontal edges of the first skin and the second skin are sewn together. Next, the first inclined edges of the first and second skins are sewn together as are the fourth inclined edge of the first skin and the second inclined edge of the second skin. The second skin is folded over upon the first skin. Then sections of the first and second provided longitudinal edges of the second skin are sewn to the first skin.

According to another preferred method according to the present invention, the procedure for the cutting, folding and sewing skins comprises the steps of: cutting the lower end portion of a first skin between its longitudinal edges to provide, from the right to the left, a first horizontal edge, a first convexly curved edge, a first vertical edge parallel to the longitudinal edges and a second horizontal edge located rearwardly of the first horizontal edge; cutting the upper portion of a second skin between its longitudinal edges to provide, from the right to the left, a first horizontal edge having the same length as the first horizontal edge of the first skin, a concavely curved edge cut to correspond to the first convex edge, and a second horizontal edge located rearwardly of the first horizontal edge of the second skin and having the same length as the second horizontal edge of the first skin; cutting the second skin at its right longitudinal edge to provide a third horizontal edge located rearwardly of the first horizontal edge, a second vertical edge parallel to the longitudinal edges, a fourth horizontal edge parallel and having the same length as the third horizontal edge, and a curved cut line defining a second convexly curved edge oriented in a direction opposite the first convexly curved edge; sewing together the first horizontal edge of the first skin and the first horizontal edge of the second skin; sewing the first convexly curved edge of the first skin to the second skin; sewing together the second horizontal edge of the first skin and the second horizontal edge of the second skin; sewing the vertical edge of the first skin to the second skin; sewing together the third and fourth horizontal edges of the second skin; and sewing the second convexly curved edge to the second skin.

It is to be understood that, if the operation or steps disclosed above are carried out alternately and inversely, i.e., by sewing a curved edge with its concavity oriented in an alternate way, a series of pleats providing an ornamental design, results. The pleats are elevated. At a slope with respect to the horizontal direction, the series of pleats occupies only the central part of the skin.

The procedure disclosed above is particularly advantageous when small, quite short skins are to be joined, which skins are particularly suitable for making collars, cuffs or hems.

BRIEF DESCRIPTION OF THE DRAWINGS

The present invention will be disclosed in detail in the following for illustrative, not limitative, purposes with reference to the enclosed drawings, wherein.

DETAILED DESCRIPTION OF THE PREFERRED EMBODIMENT

Figure 1:
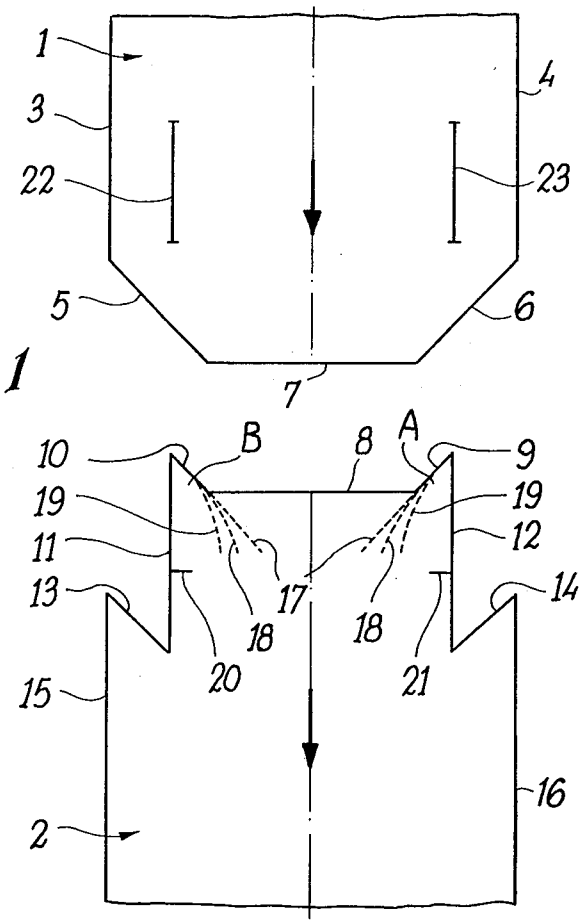
FIG. 1 is a downwardly looking view of two skins prior to sewing according to the present invention.

FIG. 1 shows two skins 1 and 2 to be joined transversely at the tail part of the skin 1 and the head part of the skin 2.

The longitudinal side segments or edges 3 and 4 of the skin 1 taper at 5 and 6 whereas the base segment or edge 7 is transversely dimensioned the same as the edge 8 of the second skin 2.

As can be clearly observed, the projecting ends A and B are defined by two inclined edges 9 and 10 which respectively terminate at the longitudinal segments or edges 12 and 11 which in turn terminate at inclined edges 13 and 14 which finally join with the longitudinal side segments or edges 15 and 16.

The fur grain is indicated by the arrows shown at the center line of the skins 1 and 2.

Figure 2:
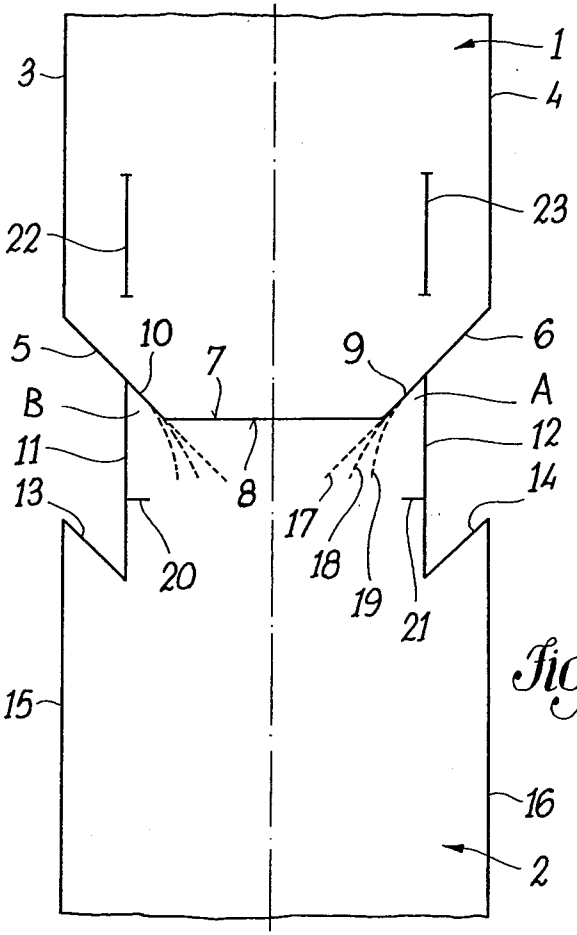
FIG. 2 is a similar view of the two skins shown in FIG. 1 joined at their horizontal edges according to the procedure of the present invention.

The lengths of the segments or edges 7 and 8 coincide and, as observed in FIG. 2, once the skins have been sewn with a horizontal seam at the edges 7 and 8, the edges 9 and 10 come into contact with tapering edges 5 and 6.

Both in FIG. 1 and in FIG. 2 the possible cut lines 17, 18 and 19 are each indicated by a dotted line. The edges 9 and 10 can have different slopes than the cut lines.

The selection from among the cut line pairs 17, 18, and 19 is made according to the width of the skins 1 and 2 in order to ensure a central horizontal edge of sufficient length.

The cut line pair 19 is selected if the skins are quite narrow, whereas the cut line pair 17 is used for skins of larger sizes.

At about the longitudinal middle of the longitudinal edges 11 and 12, two notches 20 and 21 respectively are shown whereas two lines 22 and 23 are shown in a position symmetrical with respect to the longitudinal center line of the skin 1. As can be observed more clearly in FIG. 3, once the skins 1 and 2 have been joined or sewn together at edges 7 and 8, and once the choice of a cut line pair 17, 18 or 19 has been made, the skins are folded so that the two notches 20 and 21 are aligned with the lower end of the lines 22 and 23 and so that the edges 13 and 14 meet the edges 5 and 6. Indeed, as can be observed in FIG. 2, the slope of the edges 13 and 14 coincides with that of the tapering edges 5 and 6, and the lengths of the edges 9, 10, 13 and 14 also coincide with the lengths of the tapering edges 5 and 6.

As already mentioned above, FIG. 3 shows the skins 1 and 2 as completely joined and represented as viewed from the fur side.

The seam lines are shown as a discontinuous line and, in particular, the edges 11 and 12, 13 and 14 are so represented. The edge 7 is shown as a dotted line as it is on the folded part.

The cut lines 17, shown as dotted lines as they are invisible if the skins are viewed from the fur side, are connected by the fold line 24 which is also represented as a dotted line as it also is invisible as viewed from the fur side. The line 24 represents a fold line of the tail part of skin 1 over the head part of the skin 2.

The tail part of the skin 1 joins, at the seam 7, to the head part of the skin 2. Both parts are folded to provide a flounce, the bottom of which is defined by the folding line 25. As observed from FIG. 3, the extensions of the seams at the edges 11 and 12 on the leather side, which extensions are represented as dotted lines in FIGURE and are identified by reference numbers 26 and 27, provide together with the edges 11 and 12, the sides of the flounce that is formed on the fur side.

Forming the edges of the skins 1 and 2 to what is shown in the FIGURES can be carried out easily for mass production, by cutting the skins according to the profiles of a cutting template disclosed in a patent application by the same applicant.

Figure 4:
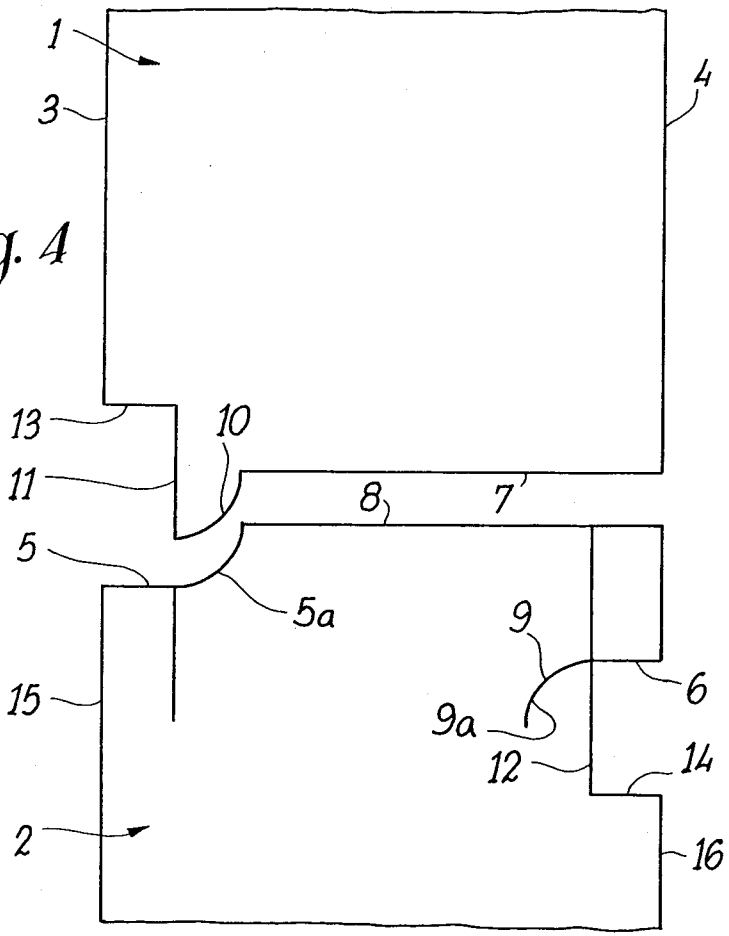
FIG. 4 is a downwardly looking view of two skins prior to sewing according to an alternative procedure of the present invention.

FIG. 4 shows two skins 1 and 2 to be joined horizontally, i.e., transversely according to an alternative procedure according to the present invention.

Figure 3:
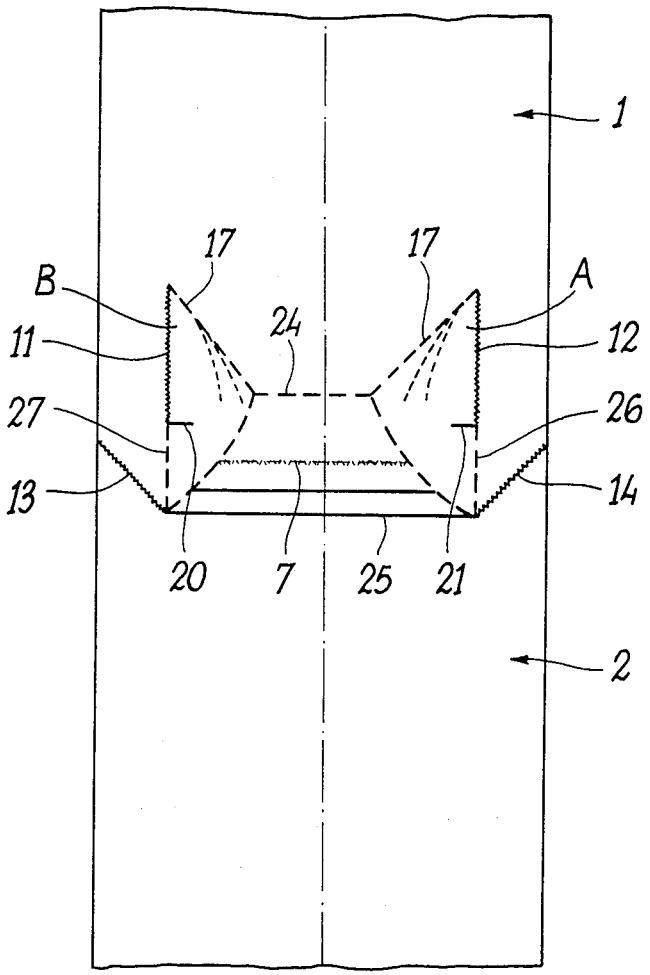
FIG. 3 is a similar view of the two successive skins shown in FIG. 1 as transversely folded and joined according to the procedure of the present invention.

All elements corresponding to those in FIGS. 1, 2 and 3 are identified by the same reference numerals.

Figure 5:
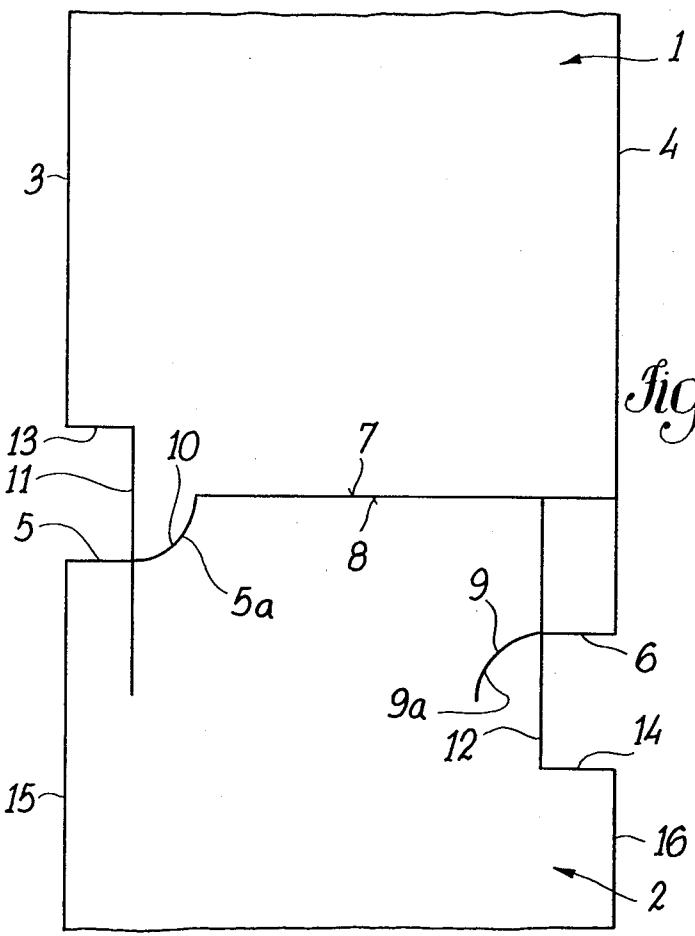
FIG. 5 is a similar view of the two skins, shown in FIG. 4, transversely joined at their central portions.
Figure 6:
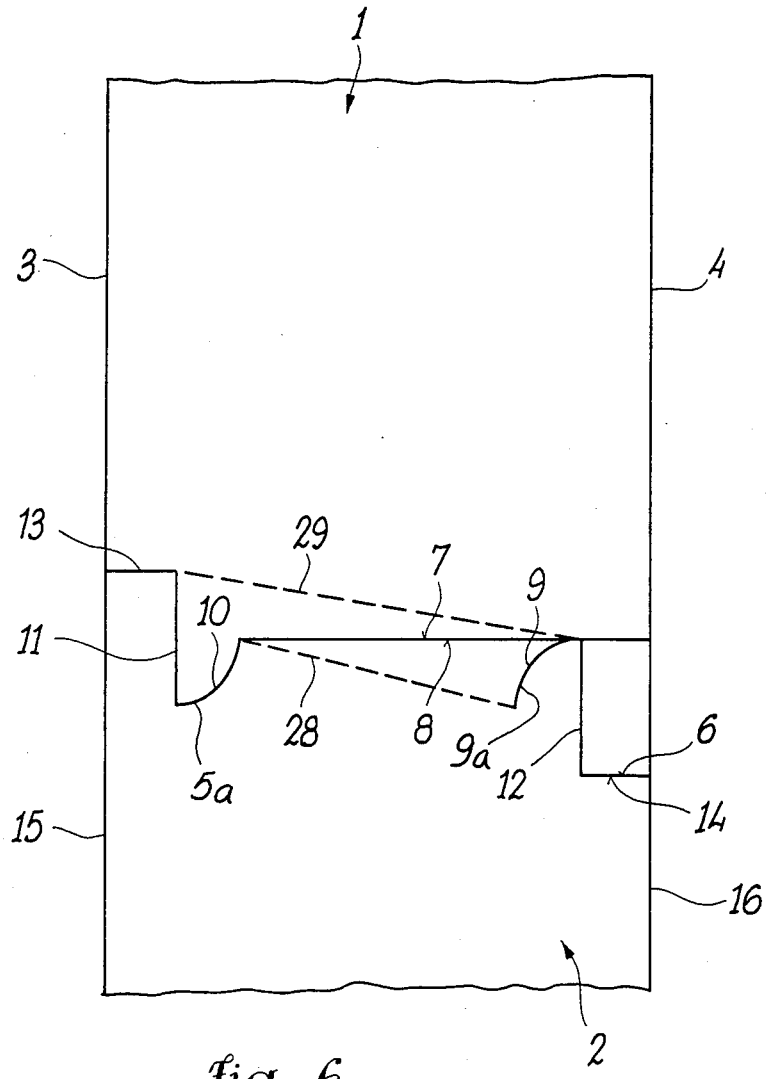
FIG. 6 is a similar view of the skins shown in FIG. 5 as transversely folded and joined according to the alternative procedure of the present invention.

As observed from FIGS. 4–6, the skin 1 is cut at its lower end portion to provide a first horizontal edge 7, a convexly curved edge 10, a longitudinal edge 11 and a second horizontal edge 13. The skin 2 is cut at its upper end portion to form the horizontal edge 8 extending from the longitudinal edge 16 to the concave edge 5*a* and another horizontal edge 5 located rearwardly of the horizontal edge 8.

A succession of cuts is also made at the edge 16, rearwardly of the seam line, for completing the resulting repeated design at the conclusion of the joining operation. The edge 16 is cut to form a horizontal edge 6, a vertical edge 12 parallel to the edge 16 and a curved cut line 9 forming a second convexly curved edge 9*a* oriented in a direction opposite to the first convex curved edge 10.

Once the skins 1 and 2 have been sewn together at the edges 7 and 8, the edge 13 is sewn to the edge 5. Then the edge 6 and the edge 14 are sewn together. Next the longitudinally-oriented edge 11 and the convexly curved edge 10 are sewn to the head part of the skin 2. The edge 12 and the convexly curved edge 9*a* are also sewn in a similar way so that a pleat is obtained The pleat slopes as is indicated by the dotted lines shown in FIG. 6.

The dotted lines 28 and 29 therefore provide, on the leather side, a kind of bulge in the joined skins which is obtained on the fur side for covering the transverse seam.

It should be noted that the procedure of cutting, folding and sewing disclosed above can also be used exclusively for aesthetic and decorative effects. In the latter situation, the cuts mentioned above can be performed at any height, at any orientation and in any number in the two longitudinal edges of the skins.

In summary, the above-described procedure for cutting, folding and sewing together skins for use in the manufacture of fur garments comprises the steps of:

A. cutting a lower end portion of a first skin 1 at its longitudinal edges to provide edges 5 and 6 having a selected slope;

B. cutting the lower portion of the first skin to provide a central horizontal edge 7;

C. cutting an upper portion of a second skin 2 rearwardly of its longitudinal side edges 15 and 16 to provide first inclined edges 13 and 14 having a slope identical with the slope of the edges 5 and 6 of the first skin 1, second edges 11 and 12 parallel to the longitudinal side edges 15 and 16 of the second skin 2 and third inclined edges 9 and 10 having the same slope as the slope of the inclined edges 5 and 6 of the first skin 1;

D. cutting the upper portion of the second skin 2 to provide a second central horizontal edge 8 extending between the cut line pairs 17, 18 or 19 between the third inclined edges 9 and 10 to have the same length as that of the horizontal central edge 7 of the first skin 1;

E. sewing the central horizontal edges 7 and 8 of the first skin 1 and the second skin 2;

F. folding the upper portion of the second skin 2 over onto the lower portion of the first skin 1 whereby the inclined edges 5, 10 and 13 and 6, 9 and 14 of the first and the second skin 1 and 2 coincide with one another;

G. at least partially sewing the second edges 11 and 12 parallel to the longitudinal side edges 15 and 16 of the second skin 2;

H. sewing together the inclined edges 5, 10 and 13 and 6, 9 and 14 of the first and of the second skin 1 and 2;

I. repeating steps A. to H. for each pair of skins.

The alternative procedure for cutting, folding and sewing skins intended for the manufacture of fur garments comprises the steps of:

(A) cutting a lower end portion of a first skin at its longitudinal edges 4 and 3 to provide, from the right to the left, a first horizontal edge 7, a first curved edge 10, an edge 11 parallel to the longitudinal edges 4 and 3 and a second horizontal edge 13 located rewardly of the first horizontal edge 7;

(B) cutting an upper portion of a second skin 2 at its longitudinal edges 16 and 15 to provide, from the right to the left, a first horizontal edge 8 having the same length as that of the first horizontal edge 7 of the first skin 1, a second curved edge 5*a* having such a concavity as to fit the first curved edge 10, and a second horizontal edge 5 located rearwardly of the first horizontal edge 8 of the second skin 2 and having the same length as that of the second horizontal edge 13 of the first skin 1;

(C) cutting the second skin 2 rearwardly of its right longitudinal edge 16 to provide a first horizontal edge 6, a second vertical edge 12 parallel to the longitudinal edge 16, a third horizontal edge 14 which is parallel to and has the same length as the first horizontal edge 6 and a third curved edge 9*a* with its concavity directed in the opposite direction as that of the first curved edge 10;

(D) sewing together the first horizontal edge 7 of the first skin with the first horizontal edge 8 of the second skin 2;

(E) sewing the first curved edge 10 of the first skin 1 onto the second skin 2;

(F) sewing together the second horizontal edge 13 of the first skin 1 and the horizontal edge 5 of the second skin 2;

(G) sewing the longitudinal edge 11 of the first skin 1 onto the second skin 2;

(H) sewing together the first and second horizontal edges 6 and 16 of the second skin 2;

(I) sewing the third curved edge 9*a* onto the second skin 2;

(L) performing steps (A), (B) and (C) as well as the respective sewing steps a number of times on the two edges alternately and inversely.

The present invention has been disclosed according to preferred embodiments of the same, but it is to be understood that modifications and changes can be introduced therein by those who are skilled in the art without departing from the spirit and scope of the invention for which priority rights are claimed.

I claim:

1. A method of cutting, folding and sewing skins for use in the manufacture of fur garments comprising the steps of:

A. cutting a lower portion of a first skin having a right longitudinal edge and a left longitudinal edge, to provide, from the right edge to the left edge, a first inclined edge, a horizontal edge located forwardly of said longitudinal edges, and a second inclined edge;

B. cutting an upper portion of a second skin having a right longitudinal edge and a left longitudinal edge, to provide, from the right edge to the left edge, a first inclined edge, a first provided longitudinal edge parallel to and extending forwardly of the first right longitudinal edge, a second inclined edge, a horizontal edge, said first provided longitudinal edge, said second inclined edge and said horizontal edge defining a first tip portion projecting forwardly of said horizontal edge, a third inclined edge, a second provided longitudinal edge parallel to said first provided longitudinal edge and extending forwardly of said left longitudinal edge, said horizontal edge, said third inclined edge and said second provided longitudinal edge defining a second tip portion projecting forwardly of said horizontal portion, and a fourth inclined edge, said first and second inclined edges of said second skin being complementary to said first inclined edge of said first skin and having a combined length equal to the length of said first inclined edge of said first skin, said third and fourth inclined edges of said second skin being complementary to said second inclined edge of said first skin and having a combined length equal to the length of said second inclined edge of said first skin, said horizontal edges of said first and second skins having equal length;

C. cutting said upper portion of said second skin at the intersection of said second inclined edge and said horizontal edge to form a first cut line, and, at the intersection of said horizontal edge and said third inclined edge to form a second cut line, said cut line having a selected inclination dependent upon the width of said skins, said cut lines extending rearwardly approximately half the length of said provided longitudinal edges to provide a horizontal fold line for said second skin;

D. sewing said horizontal edges of said first and second skins together;

E. sewing together said first inclined edge of said first skin with said first inclined edge of said second skin and said second inclined edge of said first skin and said fourth inclined edge of said second skin;

F. folding said second skin upon said first skin along said fold line of said second skin; and G. sewing a section of said first provided longitudinal edge and said second provided longitudinal edge of said second skin to said first skin.

2. A procedure for cutting, folding and sewing skins for use in the manufacture of fur garments comprising the steps of:

A. cutting a lower end portion of a first skin having a right longitudinal edge and left longitudinal edge to provide, from the right edge to the left edge, a first horizontal edge, a first convexly curved edge, a first vertical edge parallel to the longitudinal edges, and a second horizontal edge located rearwardly of the first horizontal edge;

B. cutting an upper portion of a second skin having a right longitudinal edge and a left longitudinal edge to provide, from the right edge to the left edge, a first horizontal edge edge of the first skin, a concavely curved edge corresponding to the first convexly curved edge, and a second horizontal edge located rearwardly of the first horizontal edge of the second skin and having the same length as that of the second horizontal edge of the first skin;

C. cutting the second skin at its right longitudinal edge to provide a third horizontal edge, a fourth horizontal edge located rearwardly of the third horizontal edge, the fourth horizontal edge being parallel to and having the same length as the third horizontal edge, a second vertical edge, parallel to the longitudinal edges, connecting the third and fourth horizontal edges, and a curved cut line defining a second convexly curved edge oriented in a direction opposite the first convexly curved edge;

D. sewing together the first horizontal edge of the first skin and the first horizontal edge of the second skin;

E. sewing the first convexly curved edge of the first skin to the second skin;

F. sewing together the second horizontal edge of the first skin and the second horizontal edge of the second skin;

G. sewing the vertical edge of the first skin to the second skin;

H. sewing together the third and the fourth horizontal edges of the second skin; and I. sewing the second convexly curved edge to the second skin.

* * * * *